US007748502B2

(12) United States Patent
Ueda et al.

(10) Patent No.: US 7,748,502 B2
(45) Date of Patent: Jul. 6, 2010

(54) ELEVATOR APPARATUS

(75) Inventors: Takaharu Ueda, Tokyo (JP); Masunori Shibata, Tokyo (JP); Masaya Sakai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 543 days.

(21) Appl. No.: 11/794,823

(22) PCT Filed: Apr. 13, 2006

(86) PCT No.: PCT/JP2006/307820

§ 371 (c)(1),
(2), (4) Date: Jul. 6, 2007

(87) PCT Pub. No.: WO2007/122676

PCT Pub. Date: Nov. 1, 2007

(65) Prior Publication Data

US 2009/0283367 A1 Nov. 19, 2009

(51) Int. Cl.
*B66B 1/28* (2006.01)

(52) U.S. Cl. ..... 187/293; 187/247

(58) Field of Classification Search ..... 187/247, 187/277, 289, 290, 293–297, 391, 393, 380–388; 318/66–77, 268

See application file for complete search history.

(56) References Cited

U.S. PATENT DOCUMENTS

| | | | | |
|---|---|---|---|---|
| 4,130,184 | A * | 12/1978 | Satoh et al. | 187/295 |
| 4,136,758 | A * | 1/1979 | Tachino | 187/295 |
| 4,491,197 | A * | 1/1985 | Nishiwaki | 187/296 |
| 5,266,757 | A * | 11/1993 | Krapek et al. | 187/295 |
| 7,540,358 | B2 * | 6/2009 | Okamoto et al. | 187/394 |
| 7,559,407 | B2 * | 7/2009 | Siikonen et al. | 187/382 |
| 7,575,100 | B2 * | 8/2009 | Kugiya et al. | 187/305 |
| 2005/0217945 | A1 | 10/2005 | Kimura et al. | |
| 2006/0124399 | A1 | 6/2006 | Kugiya et al. | |
| 2007/0012521 | A1 | 1/2007 | Sakai et al. | |

FOREIGN PATENT DOCUMENTS

| | | |
|---|---|---|
| DE | 10 2004 041 903 A1 | 10/2005 |
| JP | 2003-267638 | 9/2003 |
| JP | 2005-289532 | 10/2005 |
| WO | WO 98/35903 | 8/1998 |
| WO | 03050028 | 6/2003 |
| WO | 2007 013141 | 2/2007 |
| WO | 2007 055023 | 5/2007 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

In an elevator apparatus, a single car is raised and lowered by a plurality of hoisting machines. An elevator control device for controlling the hoisting machines generates speed commands separately for the hoisting machines. When a current value of one of the hoisting machines reaches a current set value, which is set in advance during acceleration of the car, the elevator control device applies the speed command for that one of the hoisting machines, whose current value has reached the current set value, to the other hoisting machine as well.

4 Claims, 6 Drawing Sheets

ELEVATOR APPARATUS

TECHNICAL FIELD

The present invention relates to an elevator apparatus employing a plurality of hoisting machines to raise and lower a single car.

BACKGROUND ART

In a conventional elevator control device, a speed pattern to be applied to a hoisting machine is changed based on a load of a car and a moving distance of the car, to thereby adjust acceleration of the car and a maximum speed of the car. That is, the acceleration of the car and the maximum speed of the car each are raised within respective allowable ranges of drive components such as a motor and an inverter, thereby being capable of shortening running time of the car (e.g., see Patent Document 1).

Patent Document 1: JP 2003-238037 A

DISCLOSURE OF THE INVENTION

Problems to be Solved by the Invention

In the conventional elevator control device configured as described above, however, burdens on the drive components are increased in a case where there occurs a major detection error in the load of the car or a great loss during running. On the other hand, the potentials of the drive components cannot be brought out to the maximum when the speed pattern is determined in consideration of the detection error in the load or the loss during running. Further, the conventional elevator control device is designed to control a single hoisting machine, and hence cannot be applied to an elevator apparatus of such a type that a single car is raised and lowered by a plurality of hoisting machines.

The present invention has been made to solve the above-mentioned problems, and it is therefore an object of the present invention to obtain an elevator apparatus that makes it possible to operate drive components more efficiently and cause a car to run more stably by means of a plurality of hoisting machines.

Means for Solving the Problems

An elevator apparatus according to the present invention includes: a car; a plurality of hoisting machines for raising and lowering the car; and an elevator control device for controlling the hoisting machines, in which the elevator control device generates speed commands separately for the hoisting machines, and applies, when a current value of one of the hoisting machines reaches a current set value, which is set in advance during acceleration of the car, the speed command for that one of the hoisting machines whose current value is at or above the current set value, to the other hoisting machine as well.

Further, an elevator apparatus according to the present invention includes: a car; a plurality of hoisting machines for raising and lowering the car; and an elevator control device for controlling the hoisting machines, in which the elevator control device generates speed commands separately for the hoisting machines, and applies, when a voltage value which is applied to one of the hoisting machines reaches a voltage set value, which is set in advance during acceleration of the car, the speed command for that one of the hoisting machines whose voltage value is at or above the voltage set value, to the other hoisting machine as well.

BEST MODE FOR CARRYING OUT THE INVENTION

Preferred embodiments of the present invention will be described hereinafter with reference to the drawings.

Embodiment 1

Figure 1:
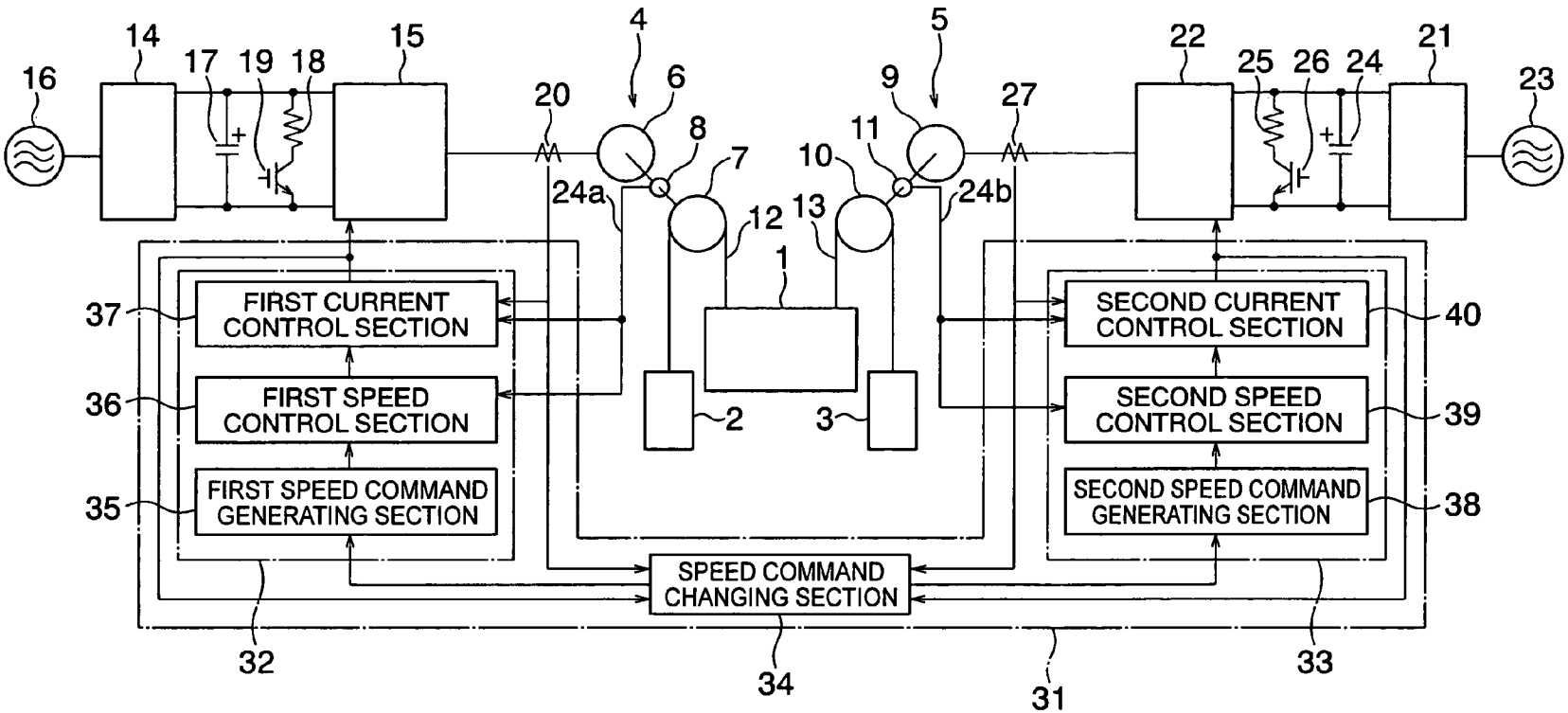
FIG. 1 is a schematic diagram showing an elevator apparatus according to Embodiment 1 of the present invention.

FIG. 1 is a schematic diagram showing an elevator apparatus according to Embodiment 1 of the present invention. A car 1, a first counterweight 2, and a second counterweight 3 are raised and lowered within a hoistway by a first hoisting machine 4 and a second hoisting machine 5. The first hoisting machine 4 has a first motor 6, a first drive sheave 7 that is rotated by the first motor 6, a first speed detector 8 for detecting a rotational speed of the first motor 6, and a first brake (not shown) for braking rotation of the first drive sheave 7.

The second hoisting machine 5 has a second motor 9, a second drive sheave 10 that is rotated by the second motor 9, a second speed detector 11 for detecting a rotational speed of the second motor 9, and a second brake (not shown) for braking rotation of the second drive sheave 10. Employed as the first speed detector 8 and the second speed detector 11 are, for example, encoders, resolvers, or the like.

A plurality of first main ropes 12 (only one of the first main ropes 12 is illustrated in FIG. 1) for suspending the car 1 and the first counterweight 2 are wound around the first drive sheave 7. A plurality of second main ropes 13 (only one of the second main ropes 13 is illustrated in FIG. 1) for suspending the car 1 and the second counterweight 3 are wound around the second drive sheave 10.

The first motor 6 is supplied with a power from a power supply 16 via a first converter 14 and a first inverter 15. A first smoothing capacitor 17 is connected between the first converter 14 and the first inverter 15. A first regenerative resistor 18 and a first regenerative switch 19 are connected in parallel to the first smoothing capacitor 17. A value of a current supplied from the first inverter 15 to the first motor 6 is detected by a first current detector 20.

The second motor 9 is supplied with a power from a power supply 23 via a second converter 21 and a second inverter 22. A second smoothing capacitor 24 is connected between the second converter 21 and the second inverter 22. A second regenerative resistor 25 and a second regenerative switch 26 are connected in parallel to the second smoothing capacitor 24. A value of a current supplied from the second inverter 22 to the second motor 9 is detected by a second current detector 27.

Alternating voltages from the power supplies 16 and 23 each are converted into direct voltages by the converters 14 and 21 respectively and smoothed by the smoothing capacitors 17 and 24 respectively. The regenerative resistors 18 and 25 consume power regenerated during regenerative operation of the hoisting machines 4 and 5 as heat, respectively. Thus, when the voltage of each of the smoothing capacitors 17 and 24 exceeds a reference value, a corresponding one of the regenerative switches 19 and 26 is turned ON to cause a current to flow through a corresponding one of the resistors 18 and 25.

When each of the regenerative switches 19 and 26 is ON, the current flows through a corresponding one of the regenerative resistors 18 and 25, so the voltage of a corresponding one of the smoothing capacitors 17 and 24 drops. When the voltage of each of the smoothing capacitors 17 and 24 drops below a predetermined value, a corresponding one of the regenerative switches 19 and 26 is turned OFF, so supply of the current to a corresponding one of the regenerative resistors 18 and 25 is stopped. As result, the voltage of each of the smoothing capacitors 17 and 24 is stopped from dropping.

As described above, the direct voltage input to each of the inverters 15 and 22 is controlled within a prescribed range by turning a corresponding one of the regenerative switches 19 and 26 on and off in accordance with the voltage of a corresponding one of the smoothing capacitors 17 and 24. Employed as the regenerative switches 19 and 26 are, for example, semiconductor switches.

The first inverter 15 and the second inverter 22 are controlled by an elevator control device 31. That is, operations of the first hoisting machine 4 and the second hoisting machine 5 are controlled by the elevator control device 31. The elevator control device 31 has a first hoisting machine control section 32 for controlling the operation of the first hoisting machine 4, a second hoisting machine control section 33 for controlling the operation of the second hoisting machine 5, and a speed command changing section 34.

The first hoisting machine control section 32 has a first speed command generating section 35, a first speed control section 36, and a first current control section 37. The first speed command generating section 35 generates a speed command for the car 1, namely, a speed command for the first hoisting machine 4 in accordance with registrations of calls from landings or calls from within the car 1.

The first speed control section 36 calculates a torque value and generates a torque command such that the rotational speed of the first motor 6 coincides with the value of the speed command, based on the speed command generated by the first speed command generating section 35 and information from the first speed detector 8.

The first current control section 37 controls the first inverter 15 based on a current detection signal from the first current detector 20 and the torque command from the first speed control section 36. More specifically, the first current control section 37 converts the torque command from the first speed control section 36 into a current command value, and outputs a signal for driving the first inverter 15 such that a value of the current detected by the first current detector 20 coincides with the current command value.

The second hoisting machine control section 33 has a second speed command generating section 38, a second speed control section 39, and a second current control section 40. The second speed command generating section 38 generates a speed command for the car 1, namely, a speed command for the second hoisting machine 5 in accordance with registrations of calls from the landings or calls from within the car 1.

The second speed control section 39 calculates a torque value and generates a torque command such that the rotational speed of the second motor 9 coincides with the value of the speed command, based on the speed command generated by the second speed command generating section 38 and information from the second speed detector 11.

The second current control section 40 controls the second inverter 22 based on a current detection signal from the second current detector 27 and the torque command from the second speed control section 39. More specifically, the second current control section 40 converts the torque command from the second speed control section 39 into a current command value, and outputs a signal for driving the second inverter 22 such that a value of the current detected by the second current detector 27 coincides with the current command value.

Vector control is adopted in controlling the currents flowing through the inverters 15 and 22 by means of the current control sections 37 and 40 respectively. That is, each of the current control sections 37 and 40 calculates a voltage value to be output by a corresponding one of the inverters 15 and 22 in accordance with the current command value obtained through conversion of the torque command and the current value of a corresponding one of the motors 6 and 9 and a magnetic pole position (a rotational position) thereof, which has been detected by a corresponding one of the current detectors 20 and 27, and outputs an on and off switching pattern to a transistor as a built-in component in the corresponding one of the inverters 15 and 22.

Each of the speed command generating sections 35 and 38 generates a speed command separately for a corresponding one of the hoisting machines 4 and 5 so as to raise the maximum speed of the car 1 and the acceleration of the car 1 to the maximum possible extent within allowable ranges of drive components (the motors 6 and 9 and electric components for driving the motors 6 and 9) and hence shorten the running time of the car 1.

The speed command changing section 34 monitors the current values input to the motors 6 and 9 from the inverters 15 and 22 respectively and the values of applied voltages (inverter command values) calculated by the current control sections 37 and 40 respectively, and prevents the first speed command generating section 35 and the second speed command generating section 38 from generating different speed commands.

More specifically, when one of the current values input to the motors 6 and 9 reaches a current set value, which is set in advance during acceleration of the motors 6 and 9, the speed command changing section 34 thereafter changes the speed command value of that one of the speed command generating sections 35 and 38, which is on the side where the current set value has not been reached, into the same value as the speed command value generated by that one of the speed command generating sections 35 and 38 which is on the side where the current set value has been reached.

Further, when one of the applied voltage values calculated by the first current control section 37 and the second current control section 40 reaches a voltage set value, which is set in advance during acceleration of the motors 6 and 9, the speed command changing section 34 thereafter changes the speed command value of that one of the speed command generating sections 35 and 38, which is on the side where the voltage set value has not been reached, into the same value as the speed command value generated by that one of the speed command generating sections 35 and 38 which is on the side where the voltage set value has been reached.

It should be noted herein that the elevator control device 31 is constituted by a computer having a calculation processing section (a CPU), a storage section (a ROM, a RAM, a hard disk, and the like), and signal input/output sections. That is, the functions of the speed command changing section 34, the speed command generating sections 35 and 38, the speed control sections 36 and 39, and the current control sections 37 and 40 are realized by the computer.

Figure 2:
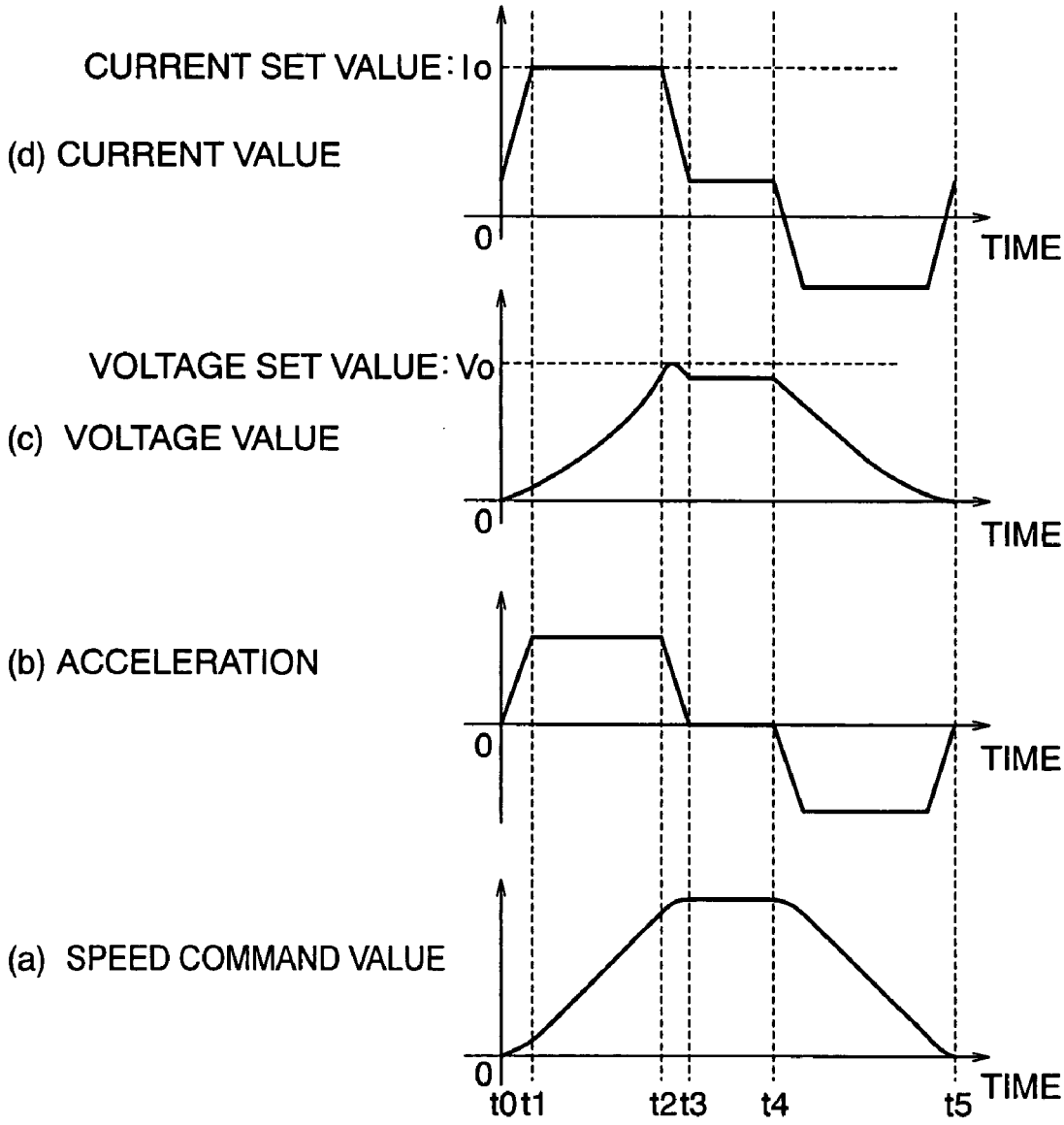
FIG. 2 is an explanatory diagram showing how a speed command generating section of FIG. 1 generates a speed command.

FIG. 2 is an explanatory diagram showing how the speed command generating section 35 of FIG. 1 generates a speed command. Referring to FIG. 2, a graph (a) shows an example of time-based changes in speed command value. A graph (b) shows time-based changes in the acceleration of the car 1 which correspond to the graph (a). A graph (c) shows time-based changes in the applied voltage value output from the current control section 37. A graph (d) shows time-based changes in the current value input to the motor 6.

According to the speed command indicated by the graph (a), the motor 6 is activated with a jerk j1 [$m/s^3$] (a derivative value of the acceleration of the graph (b)) at, for example, a time t0. After that, the acceleration of the car 1 is raised with the jerk j1 [$m/s^3$] until a time t1 at which the current value indicated by the graph (d) reaches a current set value $I_0$. The jerk is held equal to 0 after the time t1, and the car 1 is accelerated with a constant acceleration until a time t2 at which the voltage value indicated by the graph (c) reaches a voltage set value $V_0$.

The speed command is generated with a jerk j2 [$m/s^3$] from the time t2 to a time t3 so as to ensure a smooth transition at constant-speed running. After the time t3, a time t4 corresponding to the end of constant-speed running and a time t5 corresponding to the completion of running are determined in accordance with a running distance required for the car 1, a preset deceleration β [$m/s^2$], a jerk j3 [$m/s^3$] during deceleration from constant-speed running, and a jerk j4 [$m/s^3$] during a transition from constant-deceleration running to a stoppage of running, so a speed pattern is generated.

The method of generating the speed command as described above is also adopted by the speed command generating section 38. It should be noted herein that the current set value $I_0$ and the voltage set value $V_0$ are set such that allowable limit values for the motors 6 and 9 and the electric components for driving the motors 6 and 9, for example, power-supply capacities and allowable currents for the inverters 15 and 22, are not exceeded.

Figure 3:
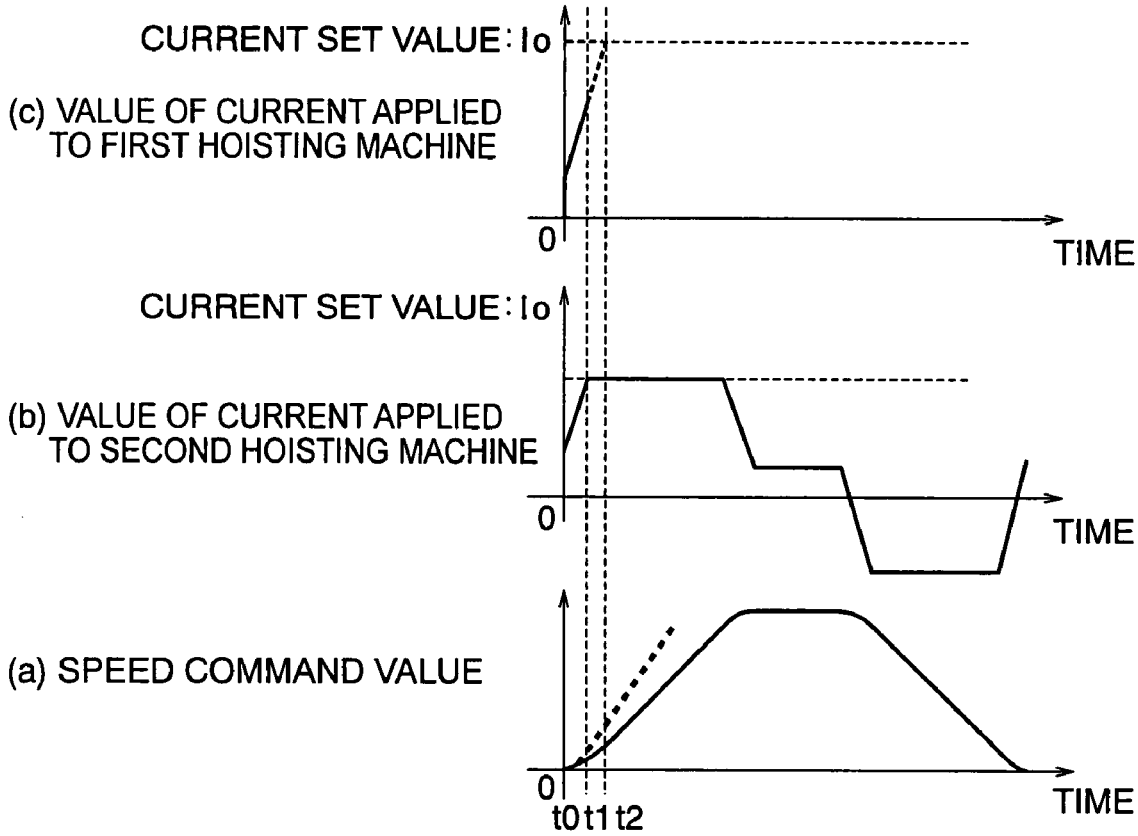
FIG. 3 is an explanatory diagram showing how a speed command changing section of FIG. 1 performs a speed command changing operation based on the monitoring of a current value.

FIG. 3 is an explanatory diagram showing how the speed command changing section 34 of FIG. 1 performs a speed command changing operation based on the monitoring of a current value. Referring to FIG. 3, a graph (a) shows an example of time-based changes in speed command value. A graph (b) shows time-based changes in the current value of the second hoisting machine 5 (the second motor 9). A graph (c) shows time-based changes in the current value of the first hoisting machine 4 (the first motor 6).

According to the speed command indicated by the graph (a), the hoisting machines 4 and 5 are activated to start accelerating the car 1 at the time t0. After that, the current value of the second hoisting machine 5 reaches the current set value $I_0$ at the time t1. On the other hand, the current value of the first hoisting machine 4 reaches the current set value $I_0$ at the time t2, which is preceded by the time t1. That is, in the example of FIG. 3, the current value of the second hoisting machine 5 reaches the current set value $I_0$ before the current value of the first hoisting machine 4 reaches the current set value $I_0$.

Thus, the speed command changing section 34 changes the speed command value of the first speed command generating section 35 (as indicated by broken lines of the graph (a)) into the speed command value generated by the second speed command generating section 38 (as indicated by a solid line of the graph (a)).

Figure 4:
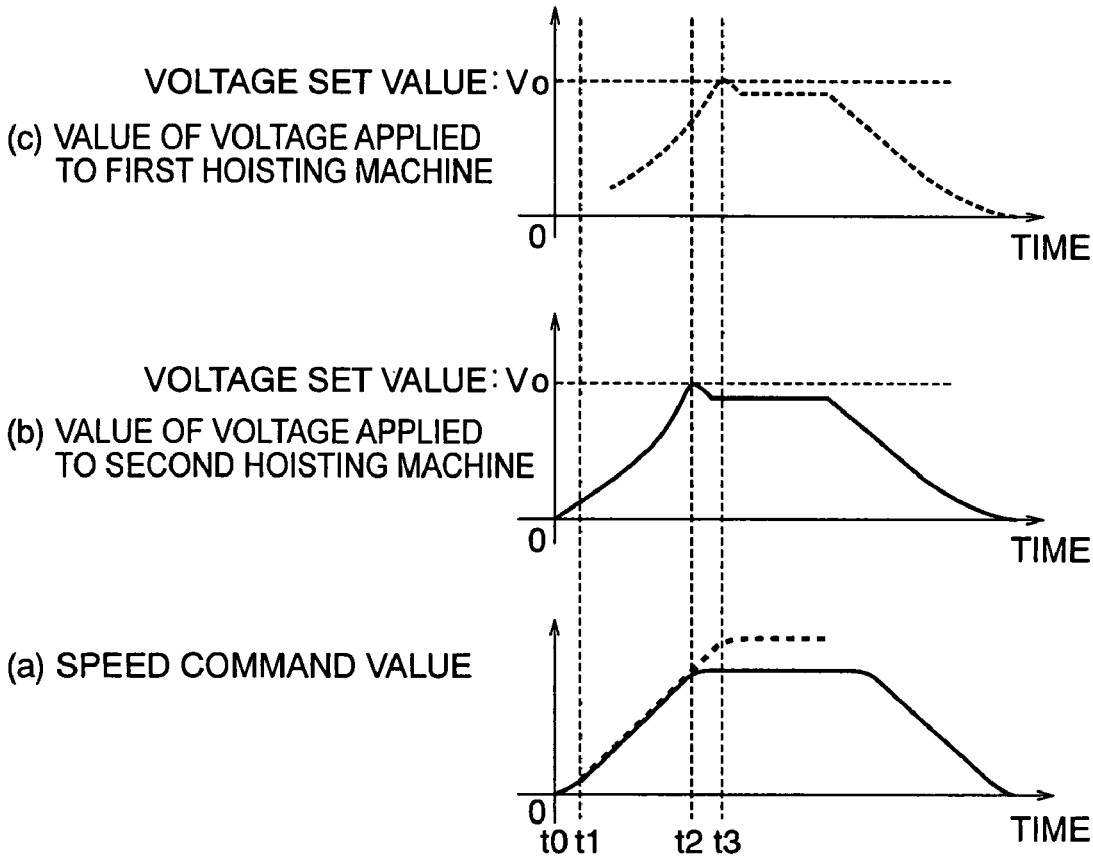
FIG. 4 is an explanatory diagram showing how the speed command changing section of FIG. 1 performs a speed command changing operation based on the monitoring of a voltage value.

FIG. 4 is an explanatory diagram showing how the speed command changing section 34 of FIG. 1 performs a speed command changing operation based on the monitoring of a voltage value. Referring to FIG. 4, a graph (a) shows an example of time-based changes in speed command value. A graph (b) shows time-based changes in the value of the voltage applied to the second hoisting machine 5. A graph (c) shows time-based changes in the value of the voltage applied to the first hoisting machine 4.

According to the speed command of the graph (a), the hoisting machines 4 and 5 are activated to start accelerating the car 1 at the time t0. After that, the value of the voltage applied to the second hoisting machine 5 reaches the voltage set value $V_0$ at the time t2. On the other hand, the value of the voltage applied to the first hoisting machine 4 reaches the voltage set value $V_0$ at the time t3, which is preceded by the time t2. That is, in the example of FIG. 4, the value of the voltage applied to the second hoisting machine 5 reaches the voltage set value $V_0$ before the value of the voltage applied to the first hoisting machine 4 reaches the voltage set value $V_0$.

Thus, the speed command changing section 34 changes the speed command value of the first speed command generating section 35 (as indicated by broken lines of the graph (a)) into the speed command value generated by the second speed command generating section 38 (as indicated by a solid line of the graph (a)).

In the elevator apparatus configured as described above, the drive components can be more efficiently operated without being affected by a detection error in the load of the car 1 or a loss caused during running. Further, the speed commands for the first hoisting machine 4 and the second hoisting machine 5 can be prevented from becoming different from each other, so the car 1 can be caused to run stably by the two hoisting machines 4 and 5.

In the foregoing example, the single elevator control device 31 performs the functions of the first hoisting machine control section 32, the second hoisting machine control section 33, and the speed command changing section 34. However, the elevator control device 31 may be divided into a plurality of control devices to perform those functions respectively.

Further, separate speed command changing sections may be employed to monitor a current and a voltage individually.

Still further, in the foregoing example, the voltage values calculated by the current control sections 37 and 40 are monitored by the speed command changing section 34. However, a duty value as a ratio of an ON time period of each of the inverters 15 and 22 within a predetermined time period may be monitored instead.

Figure 5:
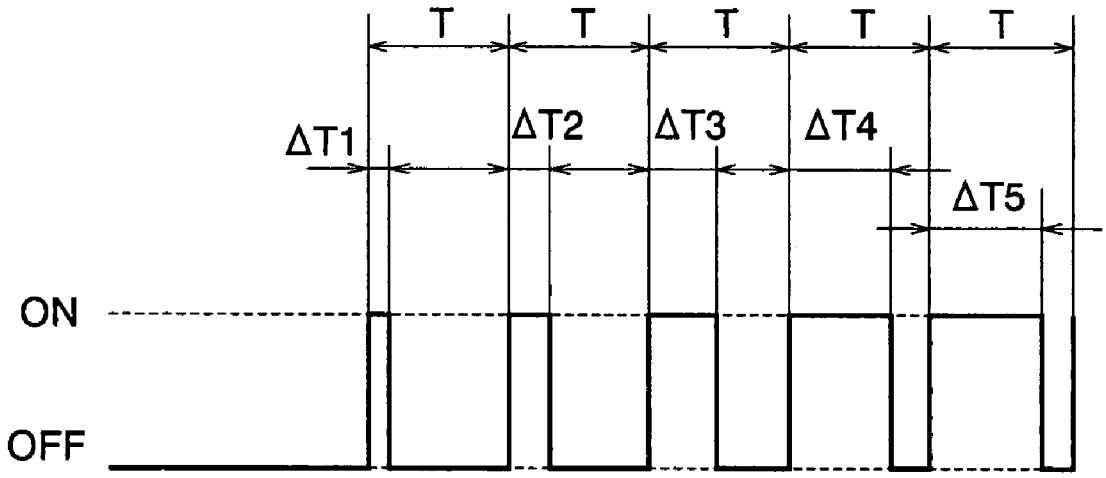
FIG. 5 is an explanatory diagram showing an example of a command signal for each of inverters of FIG. 1.

Now, FIG. 5 is an explanatory diagram showing an example of a command signal for each of the inverters 15 and 22 of FIG. 1. The ratio of the ON time period of each of the inverters 15 and 22 within a sampling time cycle T increases as the speed of the car 1 increases after the car 1 has started running. The duty value, which is calculated as ΔTi/T, is prosectional to the voltage applied to a corresponding one of the hoisting machines 4 and 5. Accordingly, the same control as in Embodiment 1 of the present invention can also be performed by monitoring the current flowing through each of the hoisting machines 4 and 5 and the duty value.

Embodiment 2

Figure 6:
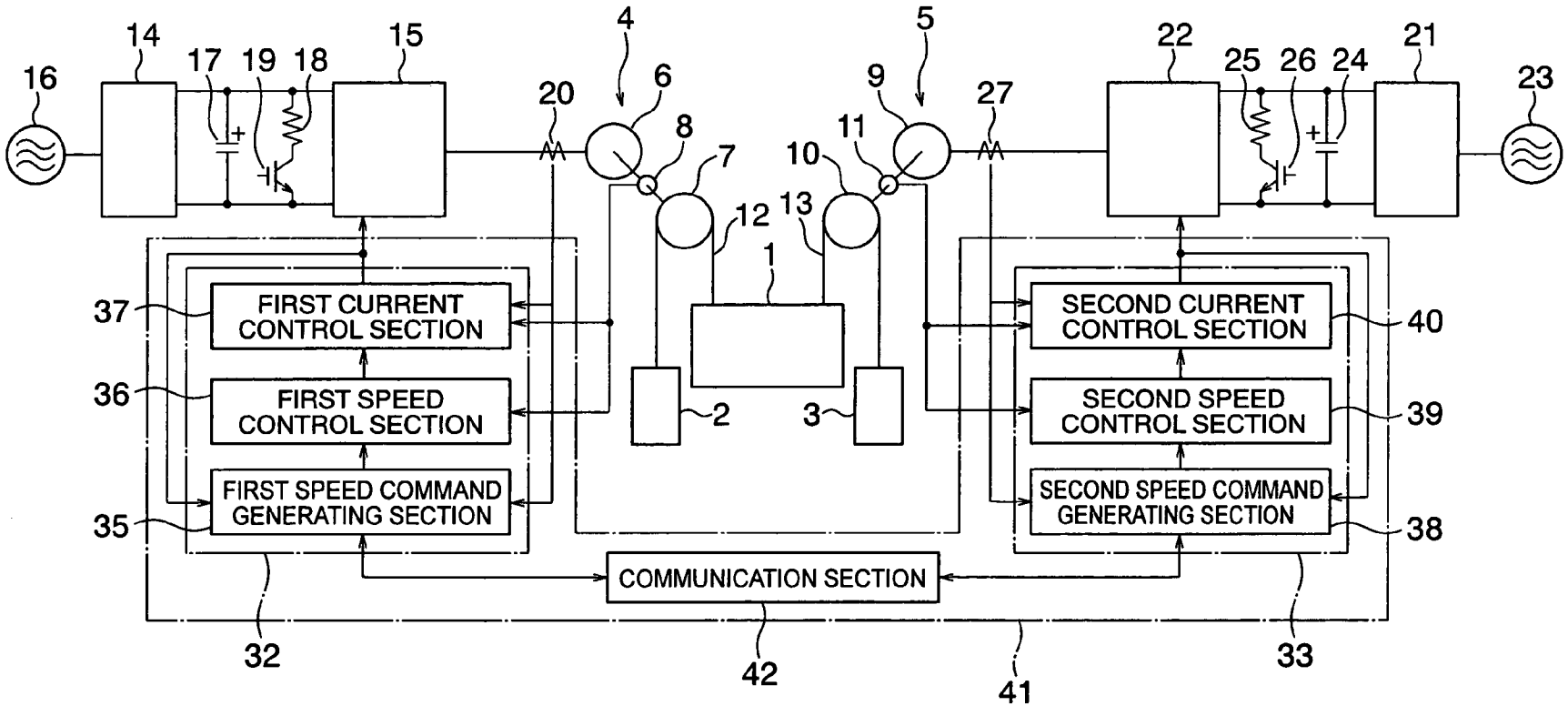
FIG. 6 is a schematic diagram showing an elevator apparatus according to Embodiment 2 of the present invention.

Next, FIG. 6 is a schematic diagram showing an elevator apparatus according to Embodiment 2 of the present invention. Referring to FIG. 6, an elevator control device 41 has the first hoisting machine control section 32, the second hoisting machine control section 33, and a communication section 42. Information can be transmitted between the first speed command generating section 35 and the second speed command generating section 38 via the communication section 42.

The first speed command generating section 35 monitors whether or not the applied voltage value calculated by the first current control section 37 reaches a voltage set value during acceleration of the first motor 6, and whether or not a current value input to the first motor 6 from the first inverter 15 reaches a current set value during acceleration of the first motor 6.

The second speed command generating section 38 monitors whether or not the applied voltage value calculated by the second current control section 40 reaches a voltage set value during acceleration of the second motor 9, and whether or not a current value input to the second motor 9 from the second inverter 22 reaches a current set value during acceleration of the second motor 9.

When the current value reaches the current set value, a corresponding one of the speed command generating sections 35 and 38 transmits the information indicative thereof to the other speed command generating section 35 or 38 on the side where the current set value has not been reached. Upon receiving the information indicating that the current value has reached the current set value, the speed command generating section 35 or 38 changes the speed command value thereof into the same value as the speed command value generated by the other speed command generating section 35 or 38 on the side where the current set value has been reached.

In addition, when the voltage value reaches the voltage set value, a corresponding one of the speed command generating sections 35 and 38 transmits the information indicative thereof to the other speed command generating section 35 or 38 on the side where the voltage set value has not been reached. Upon receiving the information indicating that the voltage value has reached the voltage set value, the speed command generating section 35 or 38 changes the speed command value thereof into the same value as the speed command value generated by the other speed command generating section 35 or 38 on the side where the voltage set value has been reached. Embodiment 2 of the present invention is identical to Embodiment 1 of the present invention in other configurational details.

As described above, the speed command generating sections 35 and 38 may be configured to transmit monitoring results of current and voltage to each other. In this manner, a simplification in configuration can be achieved through the omission of the speed command changing section 34 of Embodiment 1 of the present invention.

A function of the elevator control device 41 of Embodiment 2 of the present invention may be performed by either a single device or a plurality of separate devices.

In each of the foregoing examples, the converters 14 and 21 and the power supplies 16 and 23 are employed as the components corresponding to the first hoisting machine 4 and the second hoisting machine 5 respectively. However, a common converter and a common power supply may be employed for the first hoisting machine 4 and the second hoisting machine 5.

Further, the present invention is also applicable to an elevator apparatus employing three or more hoisting machines to raise and lower a single car.

Still further, in each of the foregoing examples, the jerk is regarded as a constant for convenience of explanation. However, the jerk may be a function of time. In this case, a reduction in running time and an improvement to obtain a comfortable ride can be achieved.

No particular limitation should be imposed on the roping method.

Further, each of the main ropes 12 and 13 may be designed as either a rope having a circular cross-section or a belt-shaped rope having a flat cross-section.

Still further, in each of the foregoing examples, the speed control of the first hoisting machine 4 and the second hoisting machine 5 is performed by the computer. However, this speed control can also be performed by a circuit for processing analog electric signals.

The invention claimed is:

1. An elevator apparatus, comprising:

a car;

a plurality of hoisting machines for raising and lowering the car; and an elevator control device for controlling the hoisting machines, wherein the elevator control device generates speed commands separately for the hoisting machines, and applies, when a current value of one of the hoisting machines reaches a current set value, which is set in advance during acceleration of the car, the speed command for that one of the hoisting machines, whose current value is at or above the current set value, to the other hoisting machine as well.

2. The elevator apparatus according to claim 1, wherein the elevator control device changes a jerk in each of the speed commands into 0 when the current value of a corresponding one of the hoisting machines reaches the current set value during acceleration of the car.

3. An elevator apparatus, comprising:

a car;

a plurality of hoisting machines for raising and lowering the car; and an elevator control device for controlling the hoisting machines, wherein the elevator control device generates speed commands separately for the hoisting machines, and applies, when a voltage value, which is applied to one of the hoisting machines, reaches a voltage set value, which is set in advance during acceleration of the car, the speed command for that one of the hoisting machines, whose voltage value is at or above the voltage set value, to the other hoisting machine as well.

4. The elevator apparatus according to claim 3, wherein the elevator control device shifts a running state of the car to constant-speed running when the value of the voltage applied to one of the hoisting machines reaches the voltage set value during acceleration of the car.

* * * * *